US005370103A

United States Patent [19]

Desselle

[11] Patent Number: 5,370,103

[45] Date of Patent: Dec. 6, 1994

[54] BOW PRESS

[76] Inventor: Kevin W. Desselle, 1245 Fairway St., Kenner, La. 70062

[21] Appl. No.: 120,032

[22] Filed: Sep. 10, 1993

[51] Int. Cl.[5] ..... F41B 5/00

[52] U.S. Cl. ..... 124/86; 124/23.1

[58] Field of Search ..... 124/23.1, 88, 90, 86; 29/246, 256, 266, 426.6, 258, 230

[56] References Cited

U.S. PATENT DOCUMENTS

| | | | |
|---|---|---|---|
| 3,000,628 | 9/1961 | Kellogg . | |
| 3,055,655 | 9/1962 | Chelf . | |
| 4,908,925 | 3/1990 | Johnson . | |
| 5,022,377 | 6/1991 | Stevens . | |
| 5,222,473 | 6/1993 | Lint | 124/86 |

FOREIGN PATENT DOCUMENTS

| | | | |
|---|---|---|---|
| 2605398 | 4/1988 | France | 124/88 |
| 2738460 | 3/1979 | Germany | 124/23.1 |

*Primary Examiner*—Eric K. Nicholson
*Assistant Examiner*—Anthony Knight
*Attorney, Agent, or Firm*—Joseph T. Regard, Ltd.

[57] ABSTRACT

A free standing bow press for compound bows is provided with a longitudinally situated stand tube having upper and lower sections. The lower section has a floor stand or stabilizer. The upper section has the press itself. The press comprises a generally laterally situated, fixed, base bar, configured for communicating with the outer end area of the limbs of the bow; situated in longitudinally adjustable fashion is the riser beam, having riser roller brackets affixed at its respective edges for communicating with the riser of the bow. The riser beam is configured to adjust in respective vertical fashion via a rack and pinion or threaded shaft arrangement (7), initiated via jack or winch (5). In operation, the riser is lifted by cranking the winch (5), lifting the riser bar and riser; the limbs of the bow are held in place via the base bar (3) to thus lessen the tension on the string, allowing servicing of the bow. An alternative embodiment of the present invention teaches a bow press configured to be supported by a work bench, table, without the necessity of a stand.

3 Claims, 2 Drawing Sheets

BOW PRESS

BACKGROUND OF THE INVENTION

1. Invention Field

The present invention relates to archery accessories, and in particular to a free standing bow press for compound bows or the like, wherein there is provided a longitudinally situated stand tube having upper and lower sections, the lower section having affixed thereto a floor stand or stabilizer, the upper section having affixed thereto the press itself.

The press comprises a generally transversely situated, fixed, base bar, configured for communicating with the outer end area of the limbs of the bow; situated in longitudinally adjustable fashion is the riser beam, having riser roller brackets affixed at its respective edges for communicating with the riser of the bow. The riser beam is configured to adjust in respective vertical fashion via a rack and pinion or threaded shaft arrangement (7), initiated via jack or winch (5).

In operation, the riser is lifted by cranking the winch (5), lifting the riser bar and riser; the limbs of the bow are held in place via the base bar (3), thereby lessening tension on the string, allowing servicing of the bow. An alternative embodiment of the present invention teaches a bow press configured to be supported by a work bench, table or the like, without the necessity of a floor stand.

The present invention provides a durable, relatively inexpensive, easily implemented system for maintaining and servicing a variety of configuration of bows in a safe and effective manner.

2. General Background Discussion

While the prior art has contemplated a variety of variously configured devices for working archery bows and the like, most have been either ineffective in accomplishing the variety of tasks necessitated in the customization and maintenance of a variety of configuration of bows, or have proved to have a propensity for structural failure over time resulting in potential damage or injury.

It is known that bow shops or the like have, in the absence of a good, inexpensive, rugged bow press on the market, been left to fashion utilizing a cable/winch arrangement, a possibly dangerous compromise if the cable or winch were to fail. In operation, the limbs are rested atop the base bar, the cable is affixed near the stabilizer hole on the riser via strap or the like, and the cable is winched tightly in a downward fashion, loosening the string.

The present, searched for invention provides what is believed to be a safer, more sturdy system for servicing compound bows and the like, wherein there is no cable to contend with or break, and wherein there is provided more even, consistent pressure on the bow, thereby preventing warping or disfigurement of same during prolonged maintenance.

A listing of patents which may be of interest relative the present invention are as follows:

| Patent Number | Inventor(s) | Date of Issue |
|---|---|---|
| 5,022,377 | Stevens | Jun 11, 1991 |
| 4,908,925 | Johnson | Mar 20, 1990 |
| 3,055,655 | Chelf | Sep 25, 1962 |
| 3,000,628 | Kellogg | Sep 19, 1961 |

U.S. Pat. No. 5,022,377 issued Jun. 11, 1991 teaches a "Portable Bow Press". Like the present device, the Stevens invention teaches a base bar (16) for communicating with the limbs of the bow; it also teaches a threaded adjustment shaft (22) which communicates with a member (38) communicating with the bow riser.

Besides the fact that the Stevens invention is taught as being utilized in a lateral position, is the teaching that the base bar (16) is the one that is adjusted in the operation, with the riser member (38) having substantially less pressure distribution, while being stationary. This is the opposite of the present invention, which teaches the base bar as stationary, and the riser bar as being adjustable.

The other devices, while teaching bow servicing devices, are nonetheless believed to be readily distinguishable from the present invention.

SUMMARY DISCUSSION OF THE INVENTION

Unlike the prior art, the present invention provides an archery bow press which is comparatively strong and reliable, while being inexpensive to manufacture, requiring little in the way of custom manufacturing equipment, while being consistent in performance and quality.

The present invention, as configured, provides an easily implemented and relatively safe system of maintaining and servicing or customizing a variety of configuration of archery bows and the like.

The preferred embodiment of the present invention teaches a free standing bow press for archery bows, including a somewhat longitudinally situated stand tube having upper and lower sections, the lower section having a fixed thereto a floor stand or stabilizer, the upper section affixed to the press. An alternative embodiment of the present invention teaches a bench supported embodiment wherein the stand is substantially shortened and configured to be fixedly attached to a counter or bench.

The press of the present invention includes a generally laterally situated, fixed, base bar, configured for communicating with the outer end area of the limbs of the bow; situated in longitudinally adjustable fashion relative the stand is the riser beam, having riser roller brackets affixed at its respective edges for communicating with the riser of the bow. The riser beam is configured to adjust in respective vertical fashion via a rack and pinion or threaded shaft arrangement via jack or winch.

In operation, the riser is lifted by cranking the winch, lifting the riser bar and riser; the limbs of the bow are held in place via the base bar, thereby lessening tension on the string, allowing servicing of the bow.

It is therefore an object of the present invention to provide an archery bow press which is safer to operate, more flexible than prior art presses and relatively cost effective to manufacture.

It is another object of the present invention to provide a bow press which provides a support for the limbs of the bow, with lateral lifting means for lifting a lateral riser bar, lessening tension on the string, allowing servicing of the bow Lastly, it is an object of the invention to provide a bow press which may be utilized with a variety of configured bows and the like.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
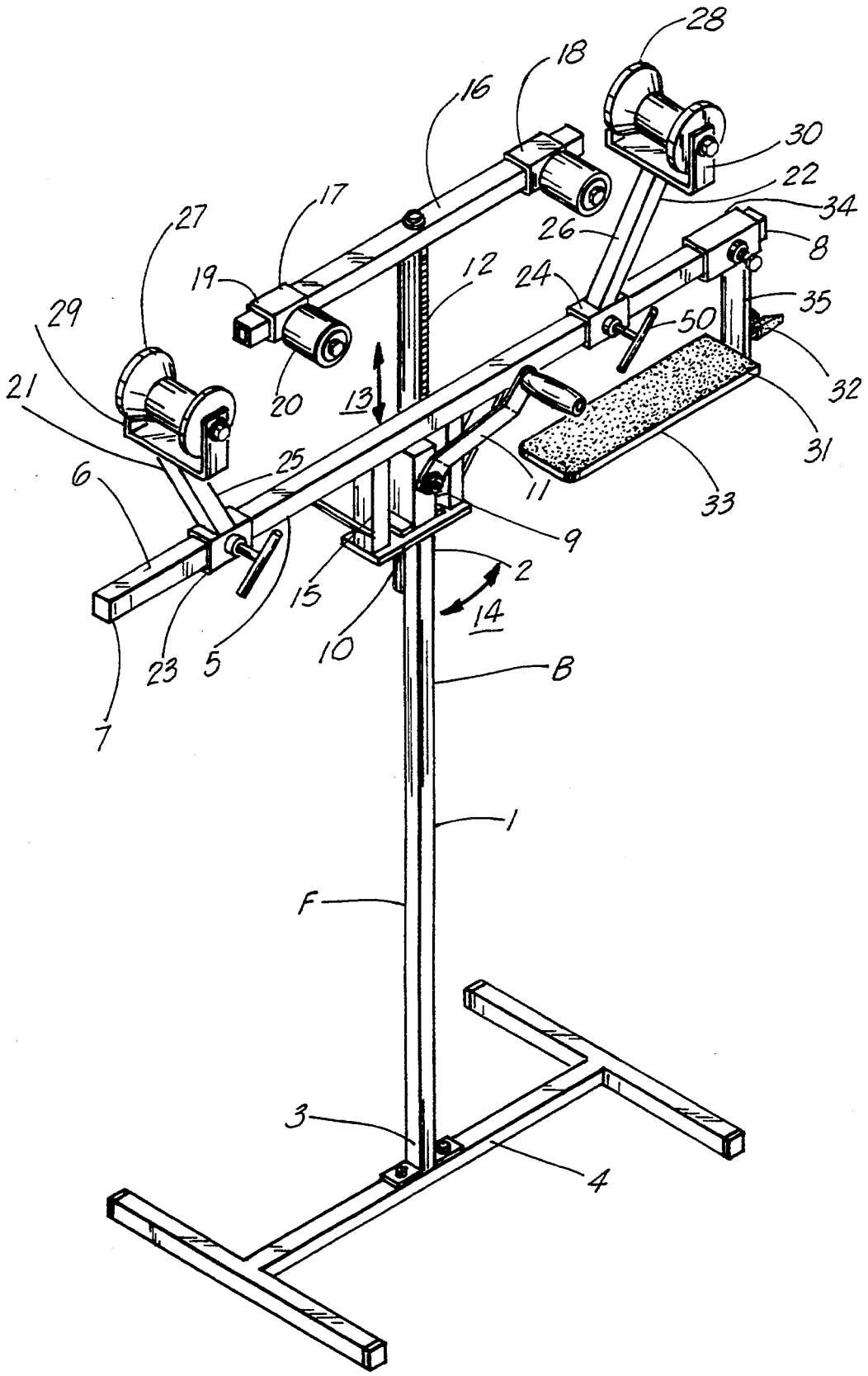
FIG. 1 of the archery bow press of the present invention illustrates an isometric view of the standing, preferred embodiment of the present invention.

As can be seen in FIG. 1, the Bow Press System B of the preferred, exemplary embodiment of the present invention, includes a floor stand F comprising a stand tube 1 having a first, upper end 2, and a second lower end 3, wherein there is affixed a floor support member 4.

Affixed to the upper end 2 of the stand tube 1 is the bow press, comprising a jack 5 mounted to the stand tube 1 via mounting plate 10. The jack 5 further includes a crank area 9 configured to envelope and communicate with riser bar 12, initiating up or down movement 13 of the riser bar 12 with the cranking 14 of handle 11.

Affixed above jack 5, and supported via support piece 15 is a transversely situated base bar 6 having a first end 7, a second end 8, with a medial area therebetween, said base bar 6 communicating with support piece 15 at about its medial area.

As shown, the upper end of the riser bar 12 is affixed to the medial section of riser beam 16, said riser beam situated in generally parallel alignment with base bar 6. Slidingly engaged to the riser beam 16 on opposing sides are riser rollers 17, 18., each of said rollers comprising a sleeve piece 19 having emanating therefrom on a common side a rotatable roller member 20. As shown, the rollers 17, 18 are configured such that their respective roller members are generally laterally situated above the base bar. Roller members are slidingly adjustable along their respective sides of the riser bar, to accommodate various sized and configured bows.

Communicating with opposing sides of the base bar are first 21 and second 22 base rollers, each of said rollers slidingly adjustable along said base bar via sleeve member 23, 24 respectively, each sleeve member having a threaded base bar engagement piece 50 for frictionally locking said sleeve member in place. Also included with said first 21 and second 22 base rollers are roller members 27, 28, supported via brackets 29, 30, respectively. Said base rollers 21, 22 are supported above said base bar via spacer bars 25, 26 respectively, which are affixed in turn to and emanate above from said sleeve members 23, 24 respectively. As shown, the preferred embodiment of the present invention teaches said spacer bars emanating from said sleeve members at an outward, distal angle relative the medial area of said bar.

The base rollers 21, 22 should be situated generally outside of the riser rollers, such that the riser rollers 17, 18 are in generally spaced relation in between or juxtaposed relative said base rollers.

Also affixed to one side of the base bar is table member 31, comprising a slidingly adjustable sleeve piece 34 having a support bar 35 affixed thereto, the support bar supporting table piece 33 for carrying miscellaneous parts and tools. The support bar 35 may also include a bow holder piece 32, comprising first and second lateral support pieces spaced to accommodate the limb of a bow; the pieces may be coated with rubber, plastic or the like to prevent scratching of the bow limb.

Figure 2:
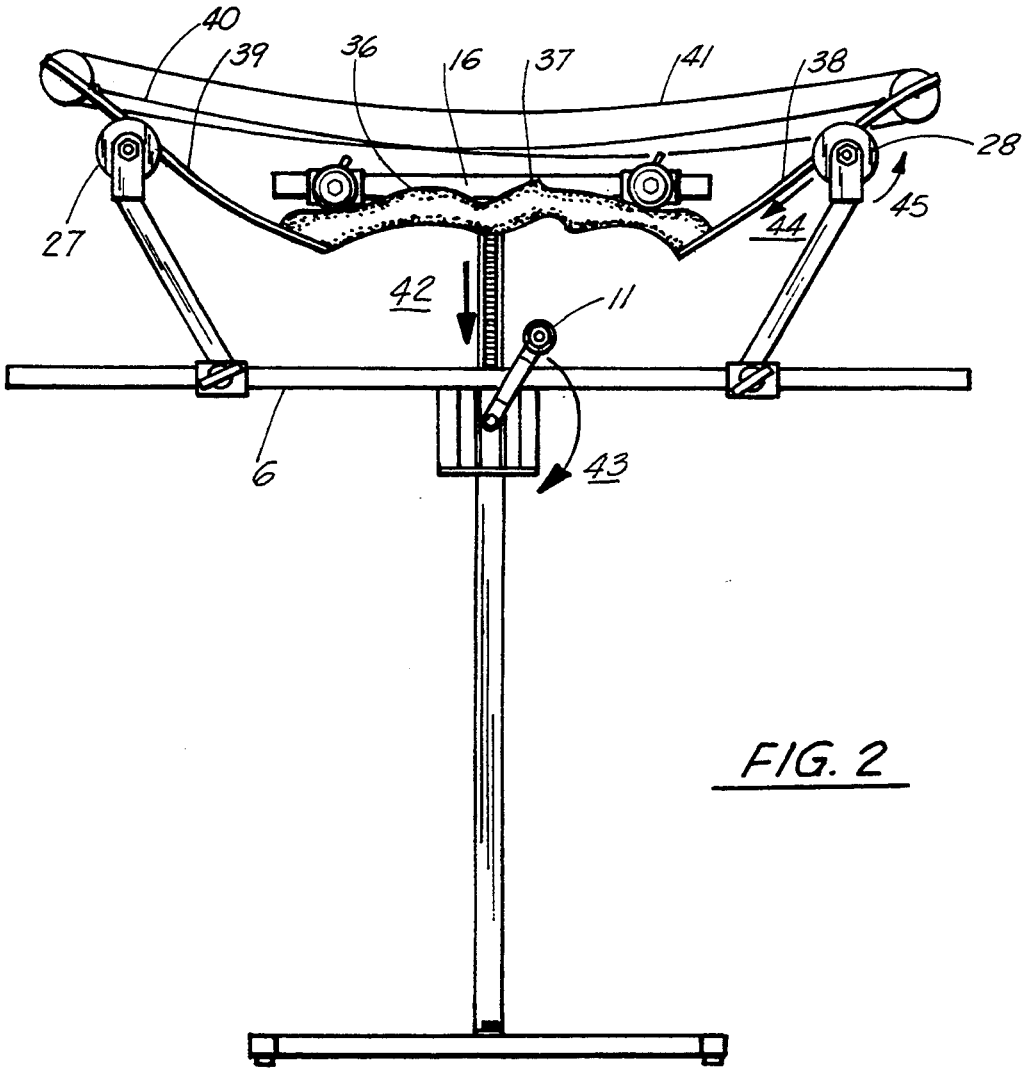
FIG. 2 is a view of the archery bow press of FIG. 1, illustrating a side view of the operation of the press.

Referring to FIG. 2, in operation, a bow 36 comprising a main body 37 having limbs 38, 39 emanating therefrom is placed so as to be aligned with and juxtaposed in between the riser rollers 17, 18, and the base rollers 27, 28, with the tension cable 40 and bow string 41 situated above said rollers and generally aligned with the base bar 6. The riser beam 16 may have to be lifted via the riser bar 12/jack 5 arrangement to accommodate placement of the bow as indicated. Further, the roller 27, 28 sleeve members 23 may have to be sliding adjusted to contact the outer limb area of the bow. Further, the riser rollers 17, 18 should be slidingly adjusted along said riser beam to contact the inner edge of the main body 37 of said bow 36.

The user then cranks 43 the hand crank, drawing the riser beam downward 42, applying downward pressure upon the main body 37 via riser rollers, causing the limbs 38, 39 to bend their tips toward each other, lessening slack on the bow string 41 and tension cables 40, thereby allowing servicing of same.

Roller members 27, 28 communicating with the limbs 39, 38 may be configured to roll 45 as said limbs are drawn down 44, increasing efficiency of the operation.

Figure 3:
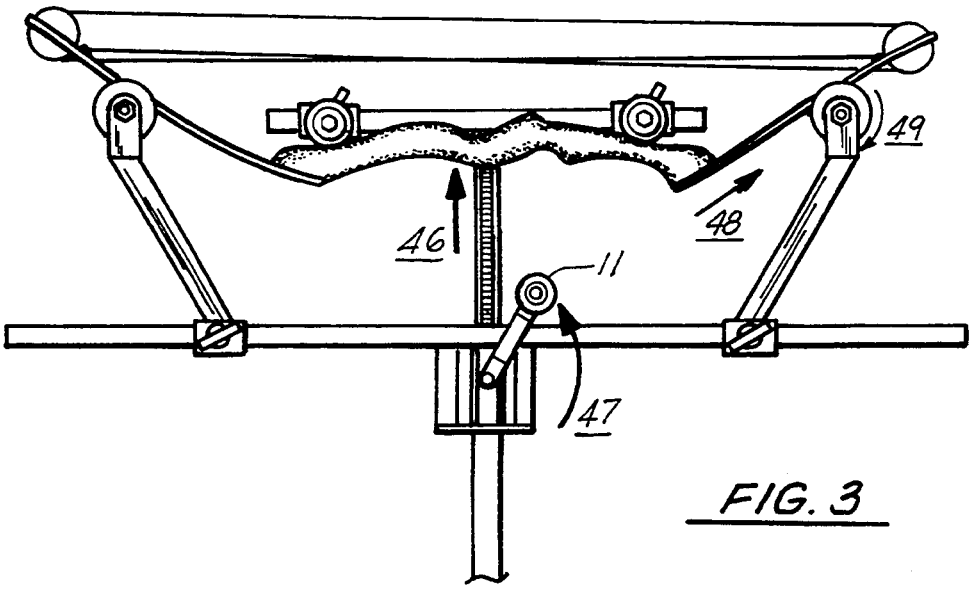
FIG. 3 is a view of the archery bow press of FIG. 1, illustrating a side view of the operation of the press.

Upon completion of servicing, customizing, or otherwise working said bow, referring to FIG. 3, the user merely cranks 47 the handle 11 in the opposite direction, causing the riser bar to move upward 46, allowing the limbs to straighten to their preferred position, lifting 48 the bow, and tightening the bowstring and tension cable back to the operating position. Again, the base rollers can be configured to rotate 49 in communication with the rising limbs of the bow, increasing efficiency of the operation.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A bow press for working an archery bow comprising:

a generally horizontally situated base bar having first and second ends, and a medial area therebetween;

a jack having a housing in general communication with the medial area of said base bar, said jack further comprising an enveloping area;

a generally vertically situated riser bar having a first, lower end, a second, upper end, and a medial area therebetween, said riser bar configured to slidingly engage said enveloping area of said jack;

a generally horizontally situated riser beam having first and second sides and a medial area therebetween, said medial area of said riser beam transversely affixed to the second, upper end of said riser bar, said riser beam in generally parallel alignment with said base bar;

first and second riser rollers slidingly affixed to said riser beam, said first and second riser rollers situated on said first and second sides of said riser beam, respectively, each of said riser rollers comprising a sleeve piece configured to envelope said riser beam, each of said sleeve pieces having a common side wherein there is attached a roller member, each of said roller member further positioned so as to be situated on an axis generally lateral relative to, and above, said base bar;

first and second base rollers slidingly affixed to opposing sides of said base bar, each of said base rollers comprising a sleeve member in slidingly adjustable communication with said base bar, a spacer member emanating upward from said sleeve member at an outward, distal angle relative the medial area of said base bar, said spacer member terminating in a bracket, said bracket configured to support a roller along an axis lateral to said base bar.

2. The bow press of claim 1, wherein said sleeve member of said rollers further includes a threaded base bar engagement piece for frictionally locking said sleeve member in place.

3. A bow press for working an archery bow comprising:

a generally horizontally situated base bar having first and second ends, and a medial area therebetween;

a jack having a housing in general communication with the medial area of said base bar, said jack further comprising an enveloping area;

a generally vertically situated riser bar having a first, lower end, a second, upper end, and a medial area therebetween, said riser bar configured to slidingly engage said enveloping area of said jack;

a generally horizontally situated riser beam having first and second sides and a medial area therebetween, said medial area of said riser beam transversely affixed to the second, upper end of said riser bar, said riser beam in generally parallel alignment with said base bar;

first and second riser rollers slidingly affixed to said riser beam, said first and second riser rollers situated on said first and second sides of said riser beam, respectively, each of said riser rollers comprising a sleeve piece configured to envelope said riser beam, each of said sleeve pieces having a common side wherein there is attached a roller member, each of said roller member further positioned so as to be situated on an axis generally lateral relative to, and above, said base bar;

first and second base rollers slidingly affixed to opposing sides of said base bar, each of said base rollers comprising a sleeve member in slidingly adjustable communication with said base bar, a spacer member emanating upward from said sleeve member, said spacer member terminating in a bracket, said bracket configured to support a roller along an axis lateral to said base bar.

said jack configured to engage said riser bar, selectively raising or lowering said riser bar, respectively increasing and lessening the distance between said riser beam and said base bar.

* * * * *

UNITED STATES PATENT AND TRADEMARK OFFICE

CERTIFICATE OF CORRECTION

PATENT NO. : 5,370,103

DATED : Dec 6, 1994

INVENTOR(S) : Desselle

It is certified that error appears in the above–identified patent and that said Letters Patent is hereby corrected as shown below:

On drawing sheet,

In the drawing, Sheet 1, Figure 1, the lead-line for reference numeral 5 should be replaced with a lead-line drawn to the rectilinear jack casing, which is centered above and mounted upon mounting plate (10).

In the abstract, line 13: change "lifted" to -- vertically adjusted --.
In the abstract, line 14, after "lifting": add -- or lowering --.
In the abstract, line 16: change "(3)" to -- (6) --.
In the specification, Column 1, line 22, before "initiated": delete "(7)".
Column 1, line 23: change "lifted" to -- vertically adjusted --.
Column 1, line 24, after "lifting": add -- or lowering --.
Column 1, line 25, after "base bar": change "(3)" to -- (6) --.
Column 2, line 53: change "lifted" to -- vertically adjusted --.
Column 2, line 54: change after "lifting": add -- or lowering --.

Signed and Sealed this

Tenth Day of October, 1995

Bruce Lehman

*Attest:*

BRUCE LEHMAN

*Attesting Officer*

*Commissioner of Patents and Trademarks*